United States Patent [19]

Thangavelu

[11] Patent Number: 5,035,302

[45] Date of Patent: Jul. 30, 1991

[54] "ARTIFICIAL INTELLIGENCE" BASED LEARNING SYSTEM PREDICTING "PEAK-PERIOD" TIMES FOR ELEVATOR DISPATCHING

[75] Inventor: Kandasamy Thangavelu, Avon, Conn.

[73] Assignee: Otis Elevator Company, Farmington, Conn.

[21] Appl. No.: 487,574

[22] Filed: Mar. 2, 1990

Related U.S. Application Data

[63] Continuation-in-part of Ser. No. 318,295, Mar. 3, 1989, Pat. No. 5,022,497, which is a continuation-in-part of Ser. No. 209,744, Jun. 21, 1988, Pat. No. 4,838,384.

[51] Int. Cl.[5] ..... B66B 1/20

[52] U.S. Cl. ..... 187/125

[58] Field of Search ..... 187/124, 125, 127

[56] References Cited

U.S. PATENT DOCUMENTS

| | | | |
|---|---|---|---|
| 4,303,851 | 12/1981 | Mottier | 235/92 |
| 4,305,479 | 12/1981 | Bittar et al. | 187/125 |
| 4,330,836 | 5/1982 | Donofrio et al. | 364/567 |
| 4,363,381 | 12/1982 | Bittar | 187/127 |
| 4,553,639 | 11/1985 | Uetani | 187/131 |
| 4,691,808 | 9/1987 | Nowak et al. | 187/125 |
| 4,804,069 | 2/1989 | Bittar et al. | 187/125 |
| 4,815,568 | 3/1989 | Bittar | 187/127 |
| 4,838,384 | 6/1989 | Thangavelu | 187/125 |
| 4,846,311 | 7/1989 | Thangavelu | 187/125 |

FOREIGN PATENT DOCUMENTS 255218 8/1963 Australia .

OTHER PUBLICATIONS

Forecasting Methods and Applications, Spyros Makridakis & Steven C. Wheelwright (John Wiley & Sons, Inc., 1978) Section 3.3: Single Exponential Smoothing and Section 3.6: "Linear Exponential Smoothing".

Intelligent Elevator Dispatching System by N. Kameli & K. Thangavelu, AI Expert, Sep. 1989; pp. 32–37.

*Primary Examiner*—A. D. Pellinen

*Assistant Examiner*—W. E. Duncanson, Jr.

*Attorney, Agent, or Firm*—Robert P. Hayter

[57] ABSTRACT

The present invention is directed to an elevator dispatching system for controlling the assignment of elevator cars. More particularly, the present invention is directed to a method of determining the commencement and/or conclusion of UP-PEAK and DOWN-PEAK periods of operation. For example, for commencing UP-PEAK operation, a lobby boarding count is predicted, based on historical information of the number of passengers boarding the elevators at the lobby. The predicted lobby boarding count is compared with a predetermined threshold value. If the predicted lobby boarding count is greater than the predetermined threshold value, UP-PEAK is commenced. In the preferred embodiment, the predetermined threshold value is a predetermined percentage of the building's population. Additionally, the present invention is directed to a method of adjusting the threshold value based on actual passenger traffic. For example, once UP-PEAK is commenced, the load of the first few elevators leaving the lobby within a predetermined time interval is determined, and the threshold value is adjusted based on their determined load. If the determined load is greater than a certain percentage of the elevator car's capacity, indicative of starting UP-PEAK too late, the threshold value is decreased. Similarly, if the determined load is less than a certain percentage of the elevator car's capacity, indicative of starting UP-PEAK too soon, the threshold value is increased.

64 Claims, 9 Drawing Sheets

GROUP CTRLR FIG. 2
17
22
15
16
CAR CTRLR OP/MO
PPT
25
27
29
26
28
30
7
8
5
6
CAB CTRLR
35
36
3
4
SPT
13
14
33
34
23
24
18
19
20
12
11
LOB PNL
21
1
2
9
10
31
32
HOISTWAY "A"
HOISTWAY "F"

"ARTIFICIAL INTELLIGENCE" BASED LEARNING SYSTEM PREDICTING "PEAK-PERIOD" TIMES FOR ELEVATOR DISPATCHING

REFERENCE TO RELATED APPLICATIONS

This application is a continuation-in-part of co-pending application Ser. No. 07/318,295 filed Mar. 3, 1989 entitled "Artificial Intelligence' Based Crowd Sensing System For Elevator Car Assignment," now Pat. No. 5,022,497 which incorporated by reference its companion application Ser. No. 07/318,307 of Kandasamy Thangavelu, the inventor hereof, entitled "Relative System Response Elevator Dispatcher System Using 'Artificial Intelligence' to Vary Bonuses and Penalties," likewise filed on Mar. 3, 1989, which '295 application is in turn a continuation-in-part of Ser. No. 07/209,744 entitled "Queue Based Elevator Dispatching System Using Peak Period Traffic Prediction" filed June 21, 1988, now U.S. Pat. No. 4,838,384 issued June 13, 1989, which incorporated by reference the disclosure of its companion application entitled "Optimized 'Up-Peak' Elevator Channeling System With Predicted Traffic Volume Equalized Sector Assignments" of Kandasamy Thangavelu, the inventor hereof, likewise filed June 21, 1988, now U.S. Pat. No. 4,846,311 issued July 11, 1989, the disclosures of which are all incorporated herein by reference.

This application also relates to some of the same subject matter as the co-pending, concurrently filed application listed below, owned by the assignee hereof, the disclosure of which is also incorporated herein by reference: Ser. No. 487,344 filed on Mar. 2, 1990, entitled "'Up-peak' Elevator Channeling System With Optimized Preferential Service To High Intensity Traffic Floors".

TECHNICAL FIELD

The present invention relates to elevator systems and to initiating and terminating "peak period" dispatching strategies in an elevator system. More particularly, the invention relates to elevator systems using different types of dispatching strategies for "up-peak" period, "down-peak" period and other than peak periods.

BACKGROUND ART

General Introduction

As elevator systems have become more sophisticated, for instance having a large number of elevators operating as a group to service a large number of floors, a need developed for determining the manner in which calls for service in either the "up" or "down" direction registered at any of the floor landings of the building are to be answered by the respective elevator cars. The most common form of elevator system group control divides the floors of the building into zones, there being one or several floors in each zone, with approximately the same number of zones as there are cars in the elevator system which can respond to group-controlled service of floor landing calls. However, this approach has had a number of drawbacks.

A more recent innovation, described in the commonly owned U.S. Pat. No. 4,363,381 entitled "Relative System Response Elevator Call Assignments" of Joseph Bittar (issued Dec. 14, 1982), included the provision of an elevator control system in which hall calls are assigned to cars based upon relative system response (RSR) factors, which take into account instantaneous system operating characteristics in accordance with a desirable scheme of operation. This scheme includes considering a plurality of desirable factors, the assignments being made based upon a relative balance among the factors in making the ultimate selection of a car to answer a hall call. The '381 invention thus provided a capability of assigning calls on a relative basis, rather than on an absolute basis, and, in doing so, used specific, pre-set values for assigning the RSR "bonuses" and "penalties".

In the invention of the subsequent Bittar U.S. Pat. No. 4,815,568 entitled "Weighted Relative System Response Elevator Car Assignment with Variable Bonuses and Penalties" (issued Mar. 28, 1989), the bonuses and penalties are varied, rather than preselected and fixed as in the prior Bittar '381 invention, as functions, for example, of recently past average waiting time and current hall call registration time, which can be used to measure the relatively current intensity of the traffic in the building. An exemplary average time period which can be used is five (5) minutes, and a time period of that order is preferred.

The hall calls are assigned to the cars, when they are received, using initial values of the bonuses and penalties to compute the RSR values.

During system operation, the average hall call waiting time for the selected past time period is estimated for hall calls answered during that time period. The hall call registration time of a specified hall call is computed, from the time when the hall call was registered. According to the invention, the penalties and bonuses are selected, so as to give preference to the hall calls that remain registered for a long time, relative to the past selected period's average waiting time of the hall calls.

When the hall call registration time is small compared to the selected time period's average waiting time, the bonuses and penalties are varied for them by increasing them. When the hall call registration time is large compared to the past selected time period's average wait time, then the call has high priority. Thus, for these situations, the bonuses and penalties are varied by decreasing them.

The above schemes treat all hall calls equally without regard to the number of people waiting behind the hall call. They also treat all cars equally without regard to the current car load, unless the car is fully loaded. It considers only the current car load, but not the expected car load when the car reaches the hall call floor. As a result the car assigned in one cycle is often deassigned later, because the car later becomes full, and another car is assigned. Often the assigned car does not have adequate capacity.

The invention of the '307 application uses an "artificial intelligence" methodology to, preferably, collect traffic data and predict traffic levels at all floors in a building at all times of the working day based on historic and real time traffic predictions.

This information is then used to predict the number of people waiting behind the hall call, and the number of people expected to be boarding and deboarding at various car stops.

Using this information, the car load when the car reaches the hall call floor is calculated, and the resulting spare capacity estimated. This spare capacity is matched with the predicted number of people waiting at the hall call floor. Any mismatch between predicted spare capacity and the number of people waiting at the hall call then is used to allow or disallow the car to answer the hall call, using a hall call mismatch penalty.

The dwell times at various floors are computed using the predicted car load and the passenger deboarding and boarding rates. The car stop penalty and the hall stop penalty are varied as functions of these dwell times and the number of people waiting behind the hall call to be assigned, so that, when a large number of people are waiting, a car with fewer "en route" stops is selected.

The stopping of a heavily loaded car to pick up a few people increases service time for a large number of people. Therefore, this is penalized by, for example, using a car load penalty which varies proportionally to the number of people in the car, but at a lower rate as a function of the number of people waiting behind the hall call.

These penalties are included in the RSR value computations. Thus, the resulting RSR value is affected by the car load at the hall call floor, the number of people waiting at the hall call floor and the number of people boarding and deboarding the car at "en route" stops. All of these values are obtained by using "artificial intelligence" based traffic prediction methodology.

The invention of the '307 application thus distributes the car load and car stops equitably, so as to minimize the service time and the waiting time of passengers and improve handling capacity.

Traffic from the lobby is usually highest in the morning in an office building. This is known as the "up-peak" period, the time of day when passengers entering the building at the lobby mostly go to certain floors and when there is little, if any, "inter-floor" traffic (i.e. few hall calls).

During an up-peak period, elevator cars that are at the lobby frequently do not have adequate capacity to handle the traffic volume to the floors to which they will travel. Some other cars may depart the lobby with less than their maximum (full) loads. Under these conditions, car availability, capacity and destinations are not efficiently matched to the immediate needs of the passengers. The passenger waiting time expands, when these loading disparities are present.

In the vast majority of group control elevator systems in use, waiting time expansion is traceable to the condition that the elevator cars respond to car calls from the lobby without regard to the actual number of passengers in the lobby that intend to go to the destination floor. Two cars can serve the same floor, separated only by some dispatching interval (the time allowed to elapse before a car is dispatched). Dispatching this way does not minimize the waiting time in the lobby, because the car load factor (the ratio of actual car load to its maximum load) is not maximized, and the number of stops made before the car returns to the lobby to receive more passengers is not minimized.

In some existing systems, for instance U.S. Pat. No. 4,305,479 to Bittar et al entitled "Variable Elevator Up Peak Dispatching Interval," assigned to Otis Elevator Company, the dispatching interval from the lobby is regulated. Sometimes, this means that a car, in a temporary dormant condition, may have to wait for other cars to be dispatched from the lobby before receiving passengers who then enter car calls for the car.

In some elevator systems, cars are assigned floors based on car calls that are entered from a central location. U.S. Pat. No. 4,691,808 to Nowak et al entitled "Adaptive Assignment of Elevator Car Calls," assigned to Otis Elevator Company, describes a system in which that takes place, as does Australian Patent No. 255,218 granted in 1961 to Leo Port. This approach directs the passengers to cars.

In the invention of U.S. Pat. No. 4,804,069 of Bittar and Thangavelu entitled "Contiguous Floor Channeling Elevator Dispatching" (issued Feb. 14, 1989), passengers may only reach a group of contiguous floors by using one car in a group of cars at a specified time. This assignment is made on a cyclical basis.

According to that invention, in a building having a plurality (X) of contiguous floors above or below a main floor, for instance the floors above a lobby, during the "up-peak period" the dispatching sequence follows a scheme by which the floors are arranged in N contiguous sectors (N being an integer less than X). N or more cars are used to serve the sectors, but each sector is assigned (served) at any one time by only one of the car. The floors in the sector assigned to (served by) a car are displayed on a indicator at the lobby. Once a car responds to the car calls for floors in the sector it is typically returned to the lobby for assignment once again to a sector. Selection of a sector for assignment is made according to a preset sequence. Cars are selected by the sequence of their approach of a committable position for stopping at the lobby. According to one aspect of that invention, sectors are selected according to numerical order, in effect a "round-robin" selection. The assignment is removed if during a cycle car calls to those floors are not entered for that car in a preset time interval. When an assignment is removed, the doors are closed and then reopened when the car is again assigned to the next sector that is selected. The floors in that sector are then displayed on the indicator.

However, the prior attempts to use such channeling to equalize the number of passengers handled by each sector has been done by selecting equal numbers of floors for each sector, which generally assumes that the traffic flow with time on a floor by floor basis is equal, which is not accurate for many building situations.

In contrast, rather than merely assigning an equal number of floors per sector, the invention of U.S. Pat. No. 4,846,311 of Thangavelu entitled "Optimized 'Up-Peak' Elevator Channeling System with Predicted Traffic Volume Equalized Sector Assignments" (issued July 11, 1989) established a method of and system for estimating the future traffic flow levels of the various floors for, for example, each five (5) minute interval, and using these traffic predictors to more intelligently assign the floors to more appropriately configured sectors, having possibly varying numbers of floors or even overlapping floors, to optimize the effects of up-peak channeling.

This estimation can be made using traffic levels measured during the past few time intervals on the given day, namely as "real time" predictors, and, when available, traffic levels measured during similar time intervals on previous days, namely "historic" predictors. The estimated traffic is then used to intelligently group floors into sectors, so that each sector ideally has equal traffic volume for each given five (5) minute period or interval.

Such intelligently assigned sectoring reduces passenger queues and the waiting times at the lobby by achieving more accurate uniform loading of the cars of the elevator system. The handling capacity of the elevator system is thus significantly increased.

Thus, by changing the sector configuration with, for example, each five (5) minute interval, by equalizing estimated traffic volume per sector, the time variation of traffic levels of various floors is appropriately served. Then, as a floor has increasing traffic volume, it has better service and often is included in two adjacent sectors.

The invention of the concurrently filed application (Ser. No. 487,344) eliminates the need for one floor to be in more than one sector, as used in the exemplary embodiment of the '311 patent. The invention of the concurrently filed application is based on the principle that the service can be further improved by not requiring all of the sectors to serve an equal traffic volume and by varying the frequency of car assignement to the sectors as a function of the traffic volume served. Such a scheme will provide high frequency service to sectors handling more than average traffic volume resulting in reduced waiting time for a large number of people. For sectors serving much less than the average sector volume, a minimum frequency will be guaranteed, to limit their maximum waiting time to pre-specified limits.

During down-peak, the floors above the lobby are divided into zones, the number of zones being the number of cars in operation minus one. Each zone consists of equal number of contiguous floors. The cars unloading passengers at the lobby are assigned to the zones in a cyclic order. Once the cars leave the lobby, the RSR algorithm assigns the hall calls to the cars so as to minimize the relative system response measure.

Thus, the algorithms selected for up-peak, down-peak and other-than-peak-periods are different. This is because the traffic in the up-peak is mostly from the lobby to the upper floors, while in the down-peak it is mostly the upper floors to the lobby. At other times there is lobby oriented and lobby generated traffic, as well as inter-floor traffic requiring an effective non-peak period algorithm.

In selecting optimal elevator dispatch strategies for peak periods, namely up-peak, down-peak and noon time, in the most common practice the start of a peak period is assumed to be the time when two cars either leave the lobby with more than a specified load [such as, for example, fifty (50%) percent of capacity] or arrive at the lobby with more than the specified load, within a specified short time interval of a few minutes. So the dispatcher waits for this event to occur to activate the peak dispatch strategies, such as up-peak channeling and down-peak zone based operation. Such a scheme delays the dispatch of empty cars from the upper floors to the lobby during the up-peak period and from the lobby to the upper floors during the down-peak period. This often results in large passenger queues and waiting time at the lobby at the start of the up-peak period and at several upper floors at the start of the down-peak period.

In elevator systems using sector based operation, the formation of sectors for up-peak channeling and zones for down-peak period operation is delayed resulting in poor service at the start of the peak periods.

Similarly the end of the up-peak period is assumed, in the most common practice, to be the time when it is identified that no car leaves the lobby with more than the specified load within the specified interval. The end of the down-peak period is set to the time when no car arrives at the lobby within the specified interval and with more than the specified load. However, this scheme often deactivates the peak period dispatch strategy before it should actually be done. In some cases it delays the switch over to non-peak period dispatching, which can be effectively served by the RSR dispatcher with "artificial intelligence" to vary the bonuses and penalties. This results in poor service to inter-floor and counter-flow traffic.

General Approach of Invention

In contrast to the most common practice, the current invention uses "artificial intelligence" based learning methodology to predict the start and end of the up-peak and down-peak periods, as well as the start and end of the "up" traffic and "down" traffic during "noon" (lunch) time.

The learning methodology in simple systems, which provide no traffic data collection, is based on certain threshold times. These times collected for successive days are used to do the prediction for the current day. In more sophisticated systems the lobby traffic data collection functions are provided. This lobby traffic data and the car departure and arrival counts at the lobby for several days and several intervals are used to predict the start and end of the peak periods.

It is noted that some of the general prediction or forecasting techniques utilized in the present invention are discussed in general (but not in any elevator context or in any context analogous thereto) in *Forecasting Methods and Applications* by Spyros Makridakis and Steven C. Wheelwright (John Wiley & Sons, Inc., 1978), particularly in Section 3.3: "Single Exponential Smoothing" and Section 3.6: "Linear Exponential Smoothing."

Disclosure of Invention

The present invention originated from the need to improve peak period dispatcher service by correctly identifying the starting and ending times of the peak periods.

The present invention provides both a simple and a sophisticated learning methodology to predict the peak period times. In the simple method the times when successive car loads at the lobby reach certain levels are recorded each day and used to predict the peak periods for the next day, preferably using exponential smoothing.

In the sophisticated method the passenger boarding and deboarding counts at the lobby and the car arrival and departure counts at the lobby are collected for each short interval each day. Based on this the passenger counts and car counts for the next day are predicted. These counts are also predicted in real time using the current day's data. The real time and historic predictions are then combined to get optimal predictions of passenger counts and car counts for each interval.

The peak period starting and ending times are based on the times when the predicted passenger boarding counts or deboarding counts for the next interval reach specified levels, as a first method. In another, second method the lobby boarding rate is calculated using the lobby passenger counts and car departure counts. The lobby deboarding rate is calculated using the lobby passenger deboarding counts and car arrival counts. In this second method the times when lobby boarding rate or deboarding rate reach predetermined levels are used as the start or end of the peak periods.

For higher reliability the peak period times predicted using passenger counts and the peak period times predicted using passenger boarding and deboarding rates are combined, preferably using a linear function, and used as the optimal predictions.

These predictions are made a few minutes before the actual occurrence of the traffic level. These predicted times are then used to determine when the peak period dispatching strategy should be activated.

By predicting the lobby boarding and deboarding counts and rates before their actual occurrence, the dispatch of empty cars to lobby or upper floors where traffic originates is also appropriately advanced. Such a strategy reduces the passenger queue lengths and waiting times at the start of the peak periods.

The scheme will form sectors for up-peak channeling and zones for down-peak operation sufficiently before the start of the peak periods, providing efficient service.

Additionally, by using the predicted traffic levels to select the ending time of the peak periods, the premature termination of the peak dispatch strategy due to short fluctuation in passenger arrival rates is also avoided. This improves the elevator service towards the end of the peak period. The switch over to non-peak period dispatching is done at the right time, improving counter-flow and inter-floor service.

By using the data collected during the past several days in terms of the threshold times or on the past several days and on the current day in terms of actual passenger boarding and deboarding counts and car departure and arrival counts at the lobby, the system is responsive to changes in passenger arrival times from day-to-day, as well as to changes during the current day. The system responds to these variations quickly and is thus highly adaptive.

Exemplary traffic levels achieving the foregoing are described and detailed further in the "best mode" section below.

The invention may be practiced in a wide variety of elevator systems, utilizing known technology, in the light of the teachings of the invention, which are discussed in detail hereafter.

Other features and advantages will be apparent from the specification and claims and from the accompanying drawings, which illustrate an exemplary embodiment of the invention.

BRIEF DESCRIPTION OF THE DRAWINGS

FIG. 1 is a simplified, schematic block diagram, partially broken away, of an exemplary elevator system in which the present invention may be incorporated; while

BEST MODE FOR CARRYING OUT THE INVENTION

Figure 1:
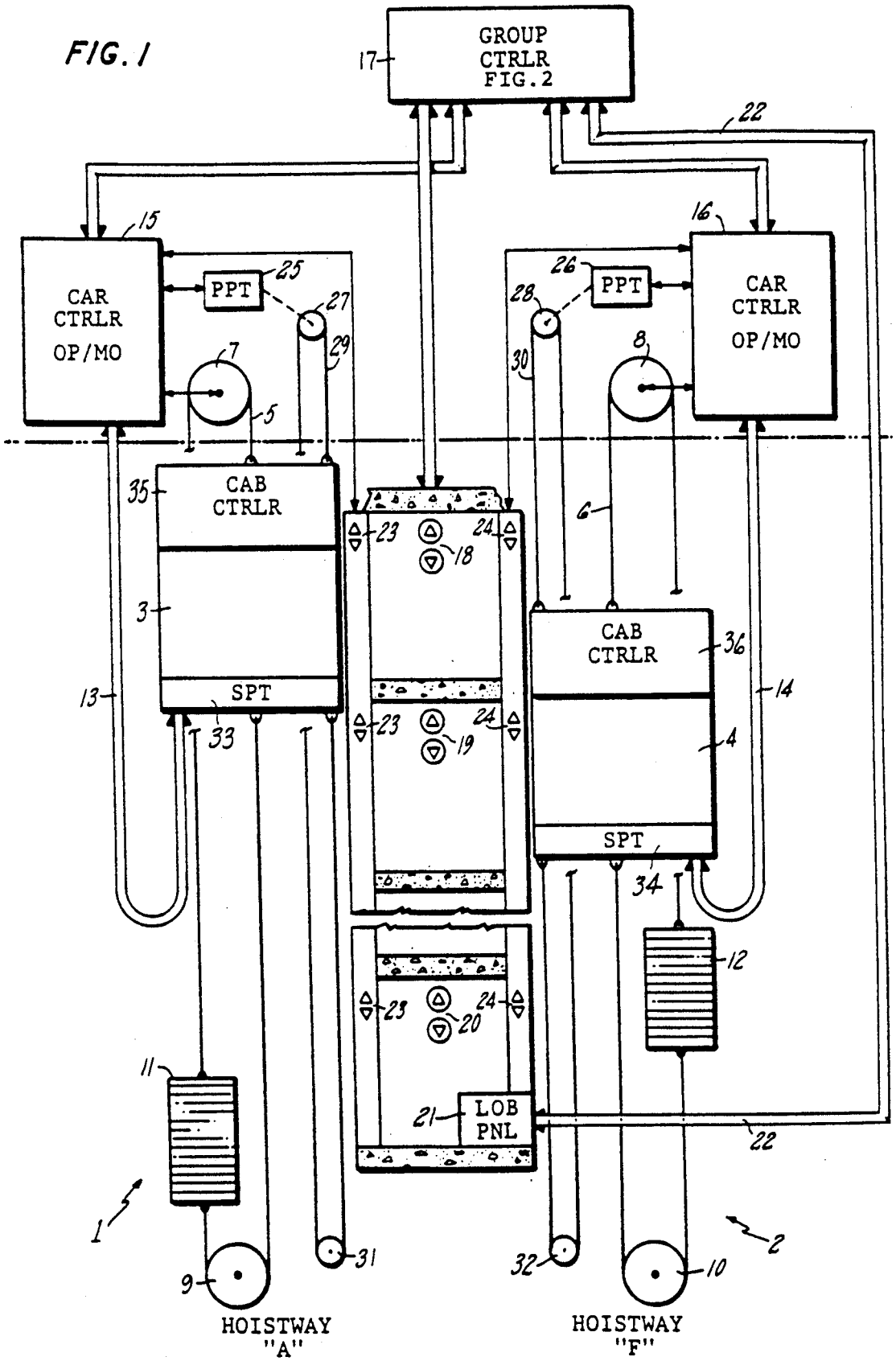

Exemplary Elevator Application (FIG. 1)

For the purposes of detailing an exemplary application for the present invention, the disclosures of the above referenced Bittar '381 patent, as well as of the commonly owned U.S. Pat. No. 4,330,836 entitled "Elevator Cab Load Measuring System" of Donofrio & Games issued May 18, 1982, are incorporated herein by reference.

Figure 2:
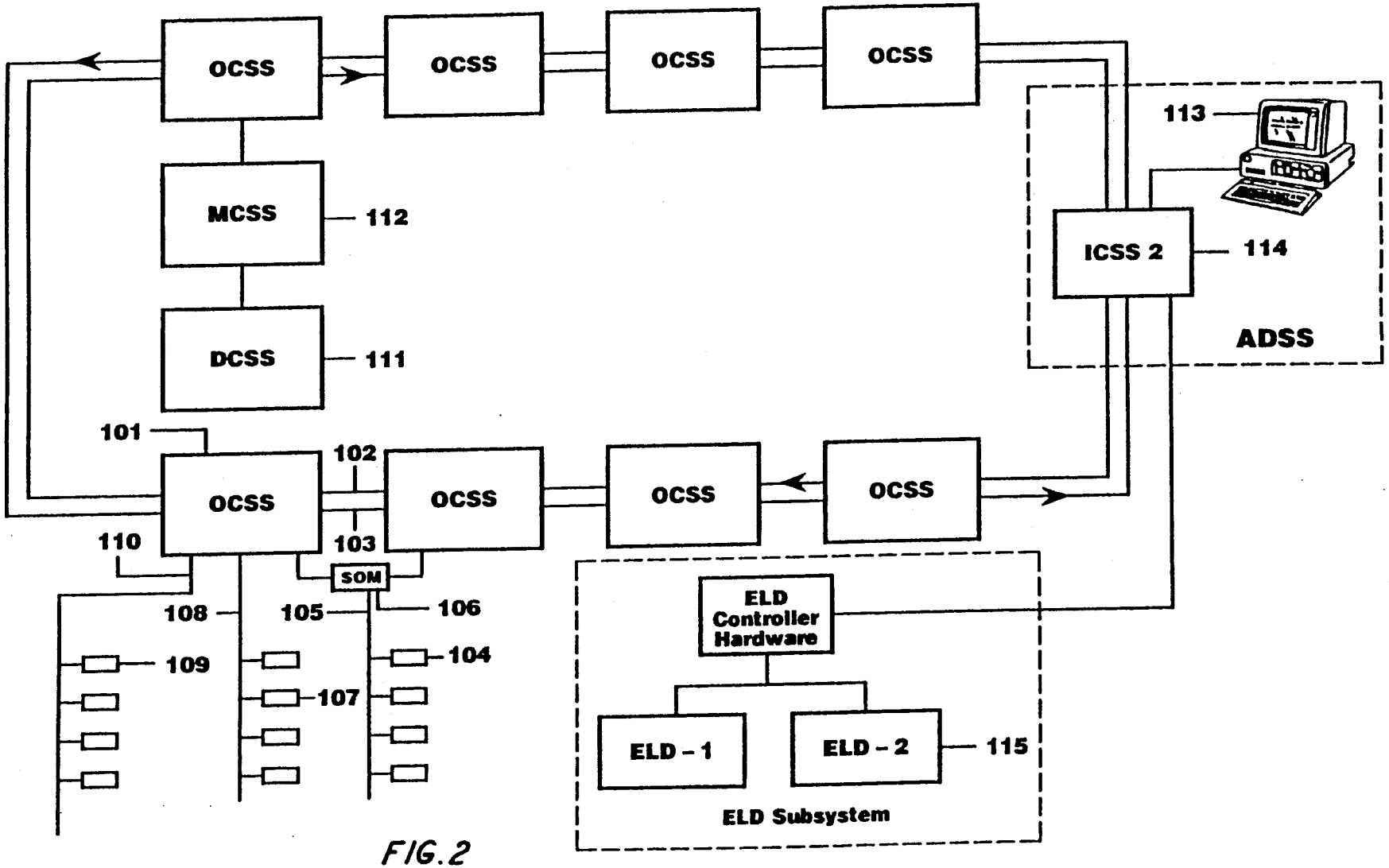
FIG. 2 is a simplified, schematic block diagram of an exemplary ring communication system for elevator group control, which may be employed in connection with the system of FIG. 1, and in which the invention may be implemented.

The preferred application for the present invention is in an elevator control system employing a microprocessor-based group controller dispatcher using signal processing means, which through generated signals communicates with the cars of the elevator system to determine the conditions of the cars and responds to hall calls registered at a plurality of landings in the building serviced by the cars under the control of the group controller, to provide assignments of the hall calls to the cars. An exemplary elevator system and an exemplary car controller (in block diagram form) are illustrated in FIGS. 1 and 2, respectively, of the '381 patent and described in detail therein.

It is noted that FIG. 1 hereof is substantively identical to FIG. 1 of the '381 and '568 patents. For the sake of brevity the elements of FIG. 1 are merely outlined or generally described below, while any further, desired operational detail can be obtained from the '381 and the '568 patents, as well as others of assignee's prior patents.

In FIG. 1 a plurality of exemplary hoistways, HOISTWAY "A" 1 and HOISTWAY "F" 2 are illustrated, the remainder not being shown for simplicity purposes. In each hoistway an elevator car or cab 3, 4 (etc.) is guided for vertical movement on rails (not shown). Each car is suspended on a steel cable 5, 6, that is driven in either direction or held in a fixed position by a drive sheave/motor/brake assembly 7, 8, and guided by an idler or return sheave 9, 10 in the well of the hoistway. The cable 5, 6 normally also carries a counterweight 11, 12, which is typically equal to approximately the weight of the cab when it is carrying half of its permissible load.

Each cab 3, 4 is connected by a traveling cable 13, 14 to a corresponding car controller 15, 16, which is typically located in a machine room at the head of the hoistways. The car controllers 15, 16 provide operation and motion control to the cabs, as is known in the art.

In the case of multi-car elevator systems, it has long been common to provide a group controller 17, which receives up and down hall calls registered on hall call buttons 18–20 on the floors of the buildings and allocates those calls to the various cars for response, and distributes cars among the floors of the building, in accordance with any one of several various modes of group operation. Modes of group operation may be controlled in part, for example, by a lobby panel ("LOB PNL") 21, which is normally connected by suitable building wiring 22 to the group controller 17 in multi-car elevator systems.

The car controllers 15, 16 also control certain hoistway functions, which relate to the corresponding car, such as the lighting of "up" and "down" response lanterns 23, 24, there being one such set of lanterns 23 assigned to each car 3, and similar sets of lanterns 24 for each other car 4, designating the hoistway door where service in response to a hall call will be provided for the respective up and down directions.

The position of the car within the hoistway may be derived from a primary position transducer ("PPT") 25, 26. Such a transducer is driven by a suitable sprocket 27, 28 in response to a steel tape 29, 30, which is connected at both of its ends to the cab and passes over an idler sprocket 31, 32 in the hoistway well.

Similarly, although not required in an elevator system to practice the present invention, detailed positional information at each floor, for more door control and for verification of floor position information derived by the "PPT" 25, 26, may employ a secondary position transducer ("SPT") 33, 34. Or, if desired, the elevator system in which the present invention is practiced may employ inner door zone and outer door zone hoistway switches of the type known in the art.

The foregoing is a description of an elevator system in general, and, as far as the description goes thus far, is equally descriptive of elevator systems known to the prior art, as well as an exemplary elevator system which could incorporate the teachings of the present invention.

All of the functions of the cab itself may be directed, or communicated with, by means of a cab controller 35, 36 in accordance with the present invention, and may provide serial, time-multiplexed communications with the car controller 15, 16, as well as direct, hard-wired communications with the car controller by means of the traveling cables 13 and 14. The cab controller, for instance, can monitor the car call buttons, door open and door close buttons, and other buttons and switches within the car. It can also control the lighting of buttons to indicate car calls and provide control over the floor indicator inside the car, which designates the approaching floor.

The cab controller 35, 36 interfaces with load weighing transducers to provide weight information used in controlling the motion, operation, and door functions of the car. The load weighing data used in the invention may use the system disclosed in the above cited '836 patent.

An additional function of the cab controller 35, 36 is to control the opening and closing of the door, in accordance with demands therefore, under conditions which are determined to be safe.

The makeup of micro-computer systems, such as may be used in the implementation of the car controllers 15, 16, the group controller 17, and the cab controllers 35, 36, can be selected from readily available components or families thereof, in accordance with known technology as described in various commercial and technical publications. The micro-computer for the group controller 17 typically will have appropriate input and output (I/O) channels, an appropriate address, data and control buss and sufficient random access memory (RAM) and appropriate read-only memory (ROM), as well as other associated circuitry, as is well known to those of skill in the art. The software structures for implementing the present invention and the peripheral features which are disclosed herein, may be organized in a wide variety of fashions.

Exemplary Ring System (FIG. 2)

In certain elevator systems, as described in co-pending application Ser. No. 07/029,495, entitled "Two-Way Ring Communication System for Elevator Group Control" (filed Mar. 23, 1987), the disclosure of which is incorporated herein by reference, the elevator group control may be distributed to separate microprocessors, one per car. These microprocessors, known as operational control subsystems (OCSS) 101, are all connected together in a two way ring communication (102, 103).

The hall buttons and lights are connected with remote stations 104 and remote serial communication links 105 to the OCSS 101 via a switch-over module 106. The car buttons, lights and switches are connected through similar remote stations 107 and serial links 108 to the OCSS 101. The car specific hall features, such as car direction and position indicators, are connected through remote stations 109 and remote serial link 110 to the OCSS 101.

The car load measurement is periodically read by the door control subsystem (DCSS) 111, which is part of the car controller. This load is sent to the motion control subsystem (MCSS) 112, which is also part of the car controller. DCSS 111 and MCSS 112 are micro-processors controlling door operation and car motion under the control of the OCSS 101.

The dispatching function is executed by the OCSS 101, under the control of the advanced dispatcher subsystem (ADSS) 113, which communicates with the OCSS 101 via the information control subsystem (ICSS) 114. The car load measured may be converted into boarding and deboarding passenger counts by the MCSS 112 and sent to OCSS 101. The OCSS sends this data to the ADSS 113 via ICSS 114.

The ADSS through signal processing collects the passenger boarding and deboarding traffic data and car departure and arrival counts at the lobby, so that, in accordance with its programming, it can predict traffic conditions at the lobby for predicting the start and end of peak periods as described below. The ADSS 113 can also collect pasenger boarding and deboarding counts at other floors and car arrival and departure counts for use in up-peak channeling [see the '311 patent and the concurrently filed application (Ser. No. 487,344)], and for varying RSR bonuses and penalties based on predicted traffic, as described in the '307 application. Reference is also had to the magazine article entitled "Intelligent Elevator Dispatching Systems" of Nader Kameli and Kandasamy Thangavelu (*AI Expert*, Sept. 1989; pp. 32–37), the disclosure of which is also incorporated herein by reference.

Electro-luminescent displays (ELDs) 115 are used to display the floors served by their respective cars when up-peak channeling is used and for information display at other times at the lobby and inside the car.

Owing to the computing capability of the "CPUs," the system can collect data on individual and group demands throughout the day to arrive at a historical record of traffic demands for each day of the week and compare it to actual demand to adjust the overall dispatching sequences to achieve a prescribed level of system and individual car performance. Following such an approach, car loading and lobby traffic may also be analyzed through signals "LW", from each car, that indicates for each car the car's load.

Actual lobby traffic may also be sensed by using a people sensor (not shown) in the lobby. The above referenced '836 patent to Donofrio et al and U.S. Pat. No. 4,303,851 to Mottier on a "People and Object Counting System," both assigned to Otis Elevator Company, show approaches that may be employed to generate these signals. Using such data and correlating it with the time of day and the day of the week, a meaningful traffic measure can be obtained for determining start and end of peak periods, in accordance with the invention by using signal processing routines that implement the sequences described in the flow charts of FIGS. 3-6, described more fully below.

Exemplary Learning System of the Dispatcher of Invention

As will be detailed below, the exemplary embodiments of the invention originated from the need to improve peak period dispatcher service by correctly identifying the starting and ending times of the peak periods.

The methodology of the invention provides for two separate approaches. One, relatively simple approach (FIG. 3) requires limited computation and can be implemented without much hardware and software; while the other uses sophisticated historic and real time traffic predictions to accurately predict the start and end of peak periods and is highly reliable.

The exemplary methodology of the invention also provides compensation for prediction errors by using multiple prediction data.

FIG. 3

Figure 3:
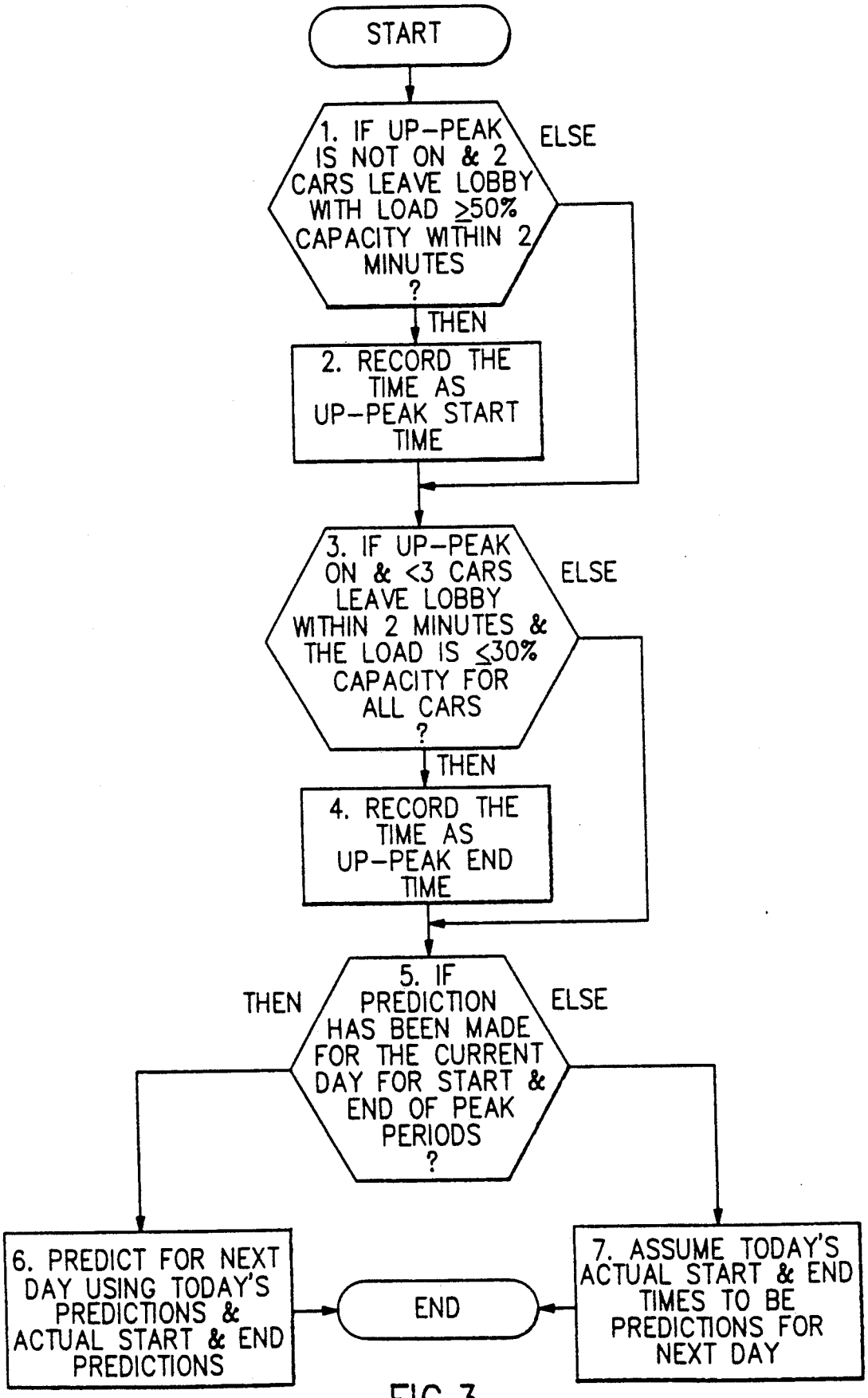
FIGS. 3 is a simplified, logic, flow chart diagram for an exemplary, relatively simple algorithm for the methodology used to predict the start and end of the up-peak period based on car load measurement at the lobby.

FIG. 3 provides in step-by-step format a simplified, logic, flow chart diagram for the exemplary algorithm for a simplified methodology used to predict the start and end of the up-peak period based solely on car load measurement at the lobby.

In Steps 1 and 2 of the relatively simple method, the time when, for example, two (2) cars leave the lobby at least, for example, fifty (≧50%) percent loaded within, for example, a two (2) minute interval in a non-up-peak period, is recorded as the start of up-peak (t_ust).

In Steps 3 and 4, when in up-peak, the time when, for example, two (2) or fewer cars [i.e. less than three (<3) cars] leave the lobby within, for example, the two (2) minute interval and the load of all of the cars is less than or equal to, for example, thirty (≦30%) percent capacity, is recorded as the end of up-peak (t_ued).

Step 5: If start and end time predictions have not been made for the current day, as occurring on the first day, then in Step 7 the times so saved on the first day are used as the predictions for the next day. If, on the other hand, start and end times for the current day have been predicted, then in Step 6 the start (t_ust) and end (t_ued) of up-peak for the next day are predicted using an exponential smoothing model. An example for the time of up-peak period start is:

$$t_ustpd(i+1)=t_ustpd(i)+\alpha\{t_ust(i)-t_ustpd(i)\}$$

where "α" is an exponential smoothing coefficient. Typical values for "α" range from, for example, 0.1 to 0.3 in typical buildings.

Thus, the prediction for the "i+1" day is obtained from the prediction for the "i"th day and the actual observation for the "i"th day. A similar prediction can also be made for the end time of the up-peak period using the exponential smoothing model.

The down-peak period is assumed to start at the time when, for example, two (2) cars arrive at the lobby at least, for example, fifty (≧50%) percent loaded within, for example, two (2) minutes.

Similarly, the end of the down-peak period is assumed to be the time when, for example, two (2) or fewer cars [i.e. less than three (<3) cars] arrive at the lobby within, for example, two (2) minutes and the load of all of the cars is less than or equal to, for example, thirty (≦30%) percent. These start and end times (t_dst and t_ded) are saved in the data base and used to predict the down-peak start and end times for the following day using the exponential smoothing model. A similar approach may also be used to predict the start and end of "noon" (lunch) time "down" traffic and "up" traffic.

The advantage of the relatively simple method is that it requires the least memory and time to execute and is easy to implement.

If there is a shift in building use or a change in office starting and ending times, the system automatically "learns" from the past few days' behavior and adapts itself to the traffic arrival and leaving patterns.

In comparison to the relatively simple methodology of the above, exemplary algorithm of FIG. 3, FIGS. 4-6 illustrate in logic flow form an exemplary, sophisticated method used in the invention to predict the start and end of peak times using predicted passenger boarding and deboarding counts and rates at the lobby. Each of them will be separately described below.

Figure 4A:
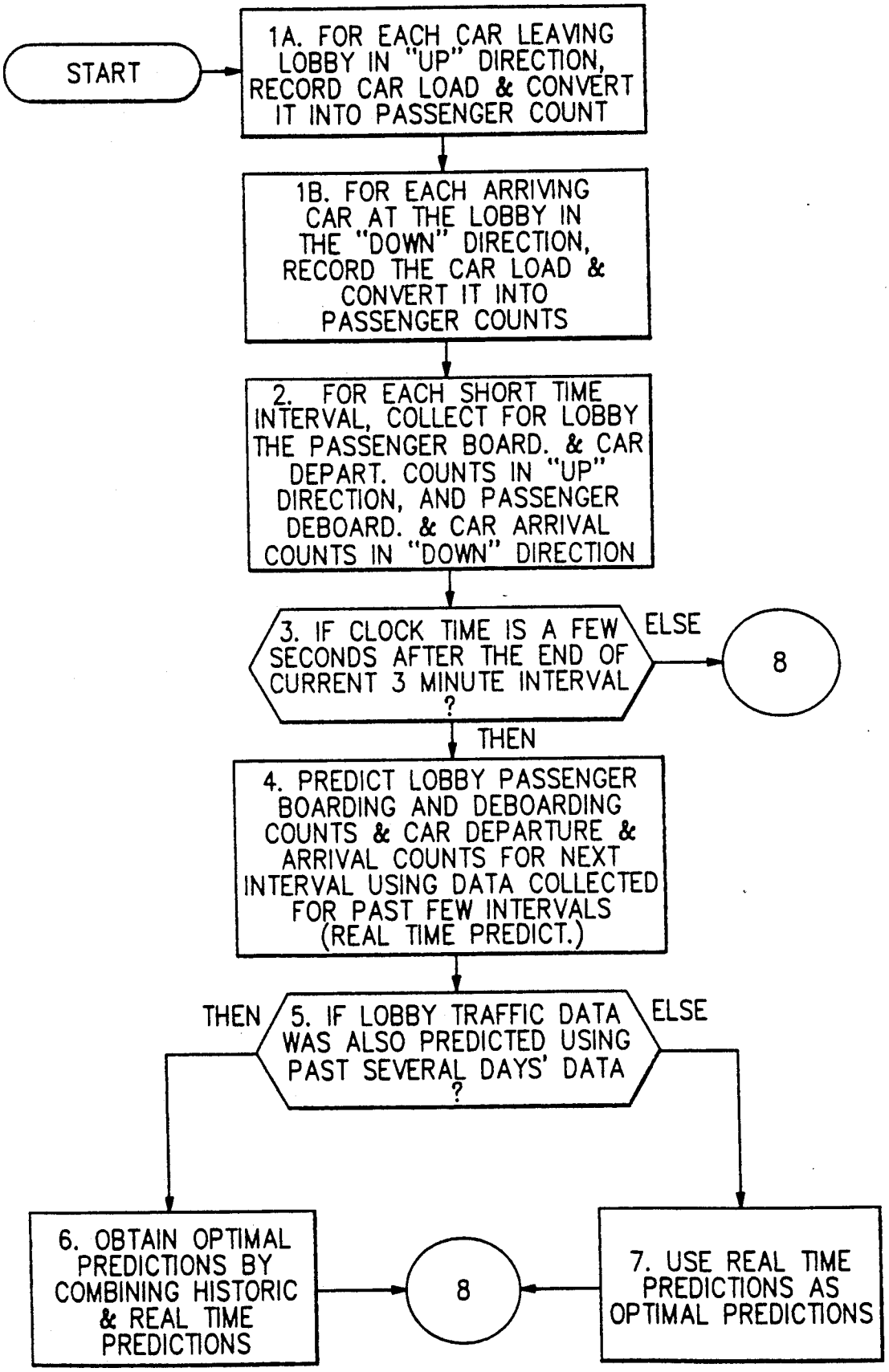
FIGS. 4A and 4B, in combination, is a simplified, logic, flow chart diagram for an exemplary algorithm for the methodology used to predict the lobby boarding and deboarding and car departure and arrival counts for predicting the up-peak period.
Figure 4B:
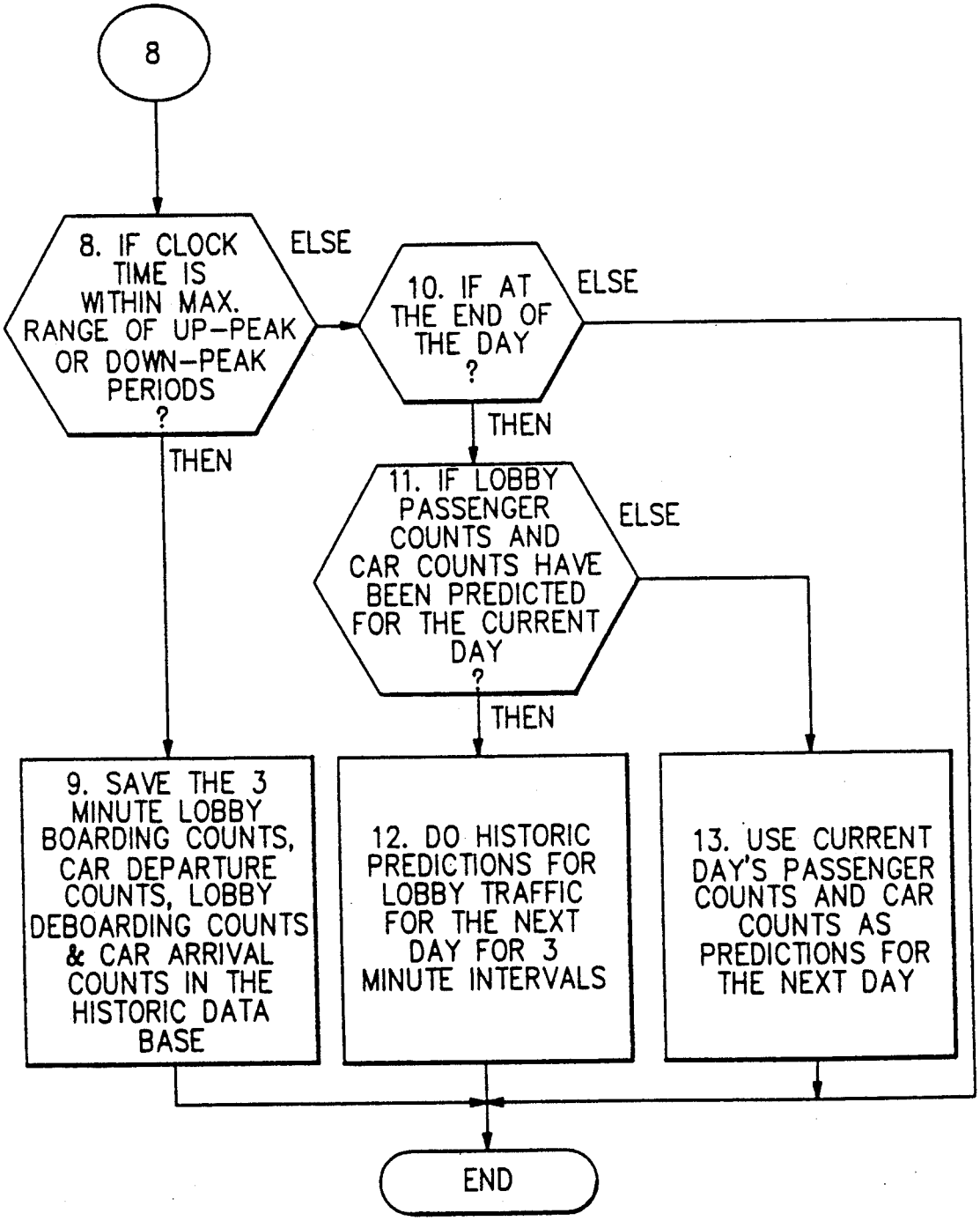

FIGS. 4A and 4B

FIGS. 4A and 4B, in combination, provide in step-by-step fashion a simplified, logic, flow chart diagram for the exemplary algorithm for the methodology used to predict the lobby boarding and deboarding counts and car arrival and departure counts for predicting the start and end of the peak periods. (Because the figures are largely self-explanatory, every step will not be discussed in great detail for the sake of brevity.)

The sophisticated method collects traffic data in the building for each short interval of the order of a few minutes, for example, three (3) minutes, in terms of lobby passenger boarding counts and car departure counts in the "up" direction (Steps 1A and 2) for predicting the up-peak period. For predicting the down-peak period, the passenger deboarding counts and car arrival counts at the lobby in the "down" direction are collected for short time intervals of, for example, three (3) minutes (Steps 1B and 2). The passenger counts can be based on direct actual counts or, as in Step 1 of FIG. 4A, recording the car load weight and using an appropriate divisor to convert it into an equivalent passenger count.

In Step 3, if the clock time is, for example, a few seconds after the current three (3) minute interval, then in Step 4 the passenger and car counts collected for the several, past, short time intervals at the lobby "today" are used to predict the boarding and deboarding and car departure and arrival counts during the next few minutes for, for example, a three (3) minute interval, at the lobby using a suitable forecasting model. This is "real time" prediction.

A prediction model known as "linear exponential smoothing" preferably is used. This method is based on two exponentially smoothed values and corrects for the lag in prediction. For a further understanding of this model, reference is had to the Makridakis/Wheelwright treatise, particularly Section 3.6.

In Steps 5 and 6, if the lobby passenger and car counts were also predicted using the past several days' data (historic data), then optimal predictions of passenger and car counts are obtained by combining the historic and the real time predictions, using the linear relationship:

$$X = ax_h + bx_r$$

where "X" is the combined prediction, "$x_h$" is the historic prediction and "$x_r$" is the real time prediction for the three (3) minute interval for the floor, and "a" and "b" are multiplication factors, whose summation is unity (a+b=1). The relative values of these multiplication factors preferably are selected as described in the '311 patent, causing the two types of predictors to be relatively weighted in favor of one or the other, or given equal weight if the "constants" are equal, as desired.

If in Step 5 it was decided that historic predictions were not made, then in Step 7 the real time predictions are used as the optimal predictions.

In Steps 8 and 9, if the clock time is within the range of up-peak or down-peak period, then the past three (3) minute lobby boarding and deboarding counts and car departure and arrival counts are recorded and saved in the historic data base.

The peak period traffic data collection is started several minutes, for example, fifteen (15) minutes, before the predicted start of the peak period of the previous day. The peak period traffic collection ends several minutes after the predicted end of the peak period of the current day. Thus, unintentional miss of peak period traffic data collection is avoided. If the real time predictions indicate that the peak period on a particular day has to commence earlier than usual due to unusual traffic, this is automatically taken care of.

The traffic is also predicted or forecast at the end of the day in Step 10 and its subsequent Steps 11, 12 and 13, for, for example, each three (3) minute up-peak and down-peak interval of the next day, using data collected during the past several days for such interval and using the "single exponential smoothing" model, giving the "historic" prediction. For a further understanding of this model, reference again is had to the Makridakis/-Wheelwright treatise, particularly Section 3.3.

The inclusion of real time prediction in the combined prediction and the use of linear exponential smoothing for real time prediction results in a rapid response to today's variation in traffic.

Figure 5A:
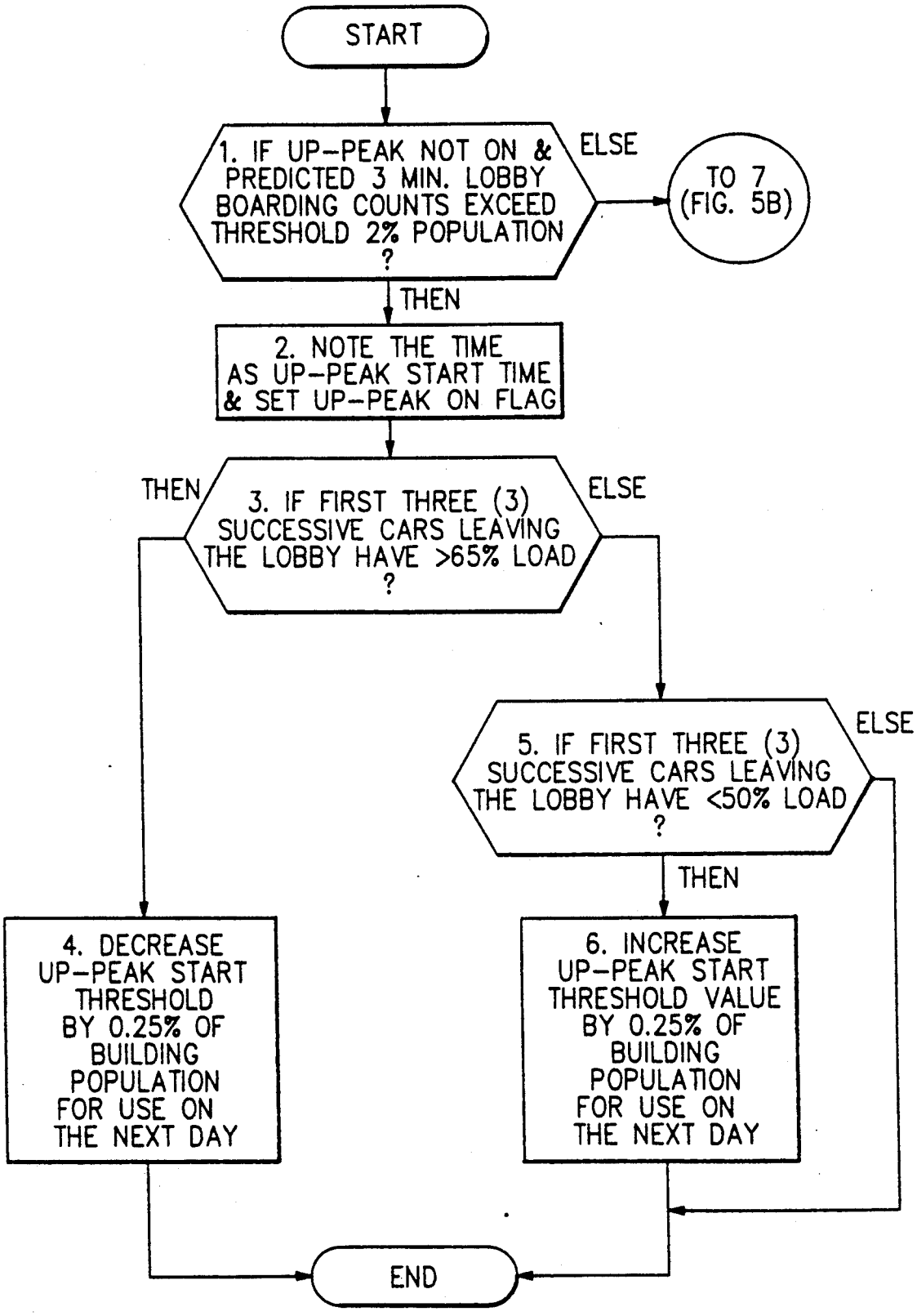
FIGS. 5A and 5B, in combination, is a simplified, logic, flow chart diagram for an exemplary algorithm for the methodology used to determine the start and end of the up-peak period based on lobby boarding counts.
Figure 5B:
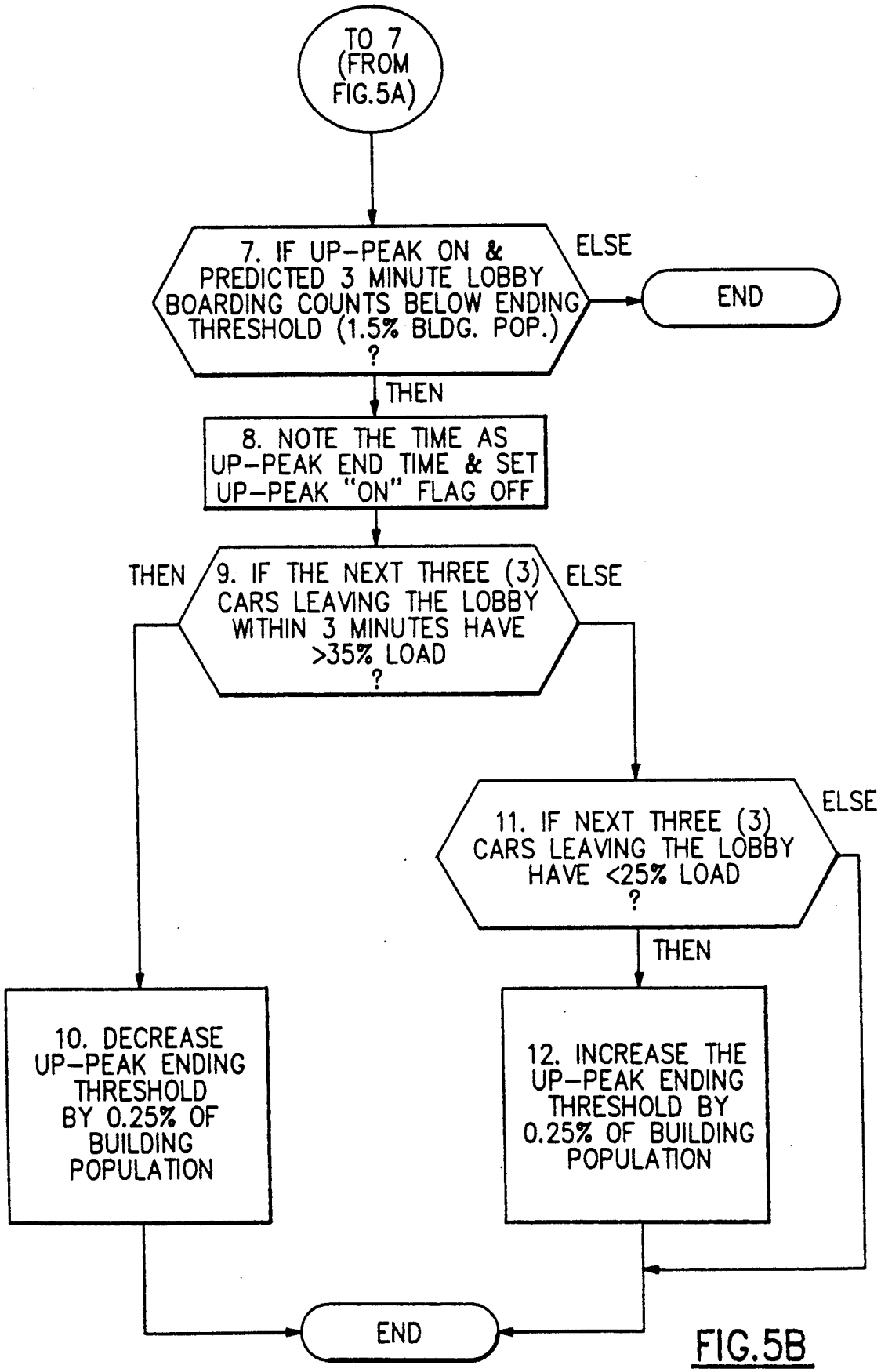

FIGS. 5A and 5B

FIGS. 5A and 5B, in combination, provides in step-by-step fashion a simplified, logic, flow chart diagram for the exemplary algorithm for the methodology used to determine the start and end of the up-peak period based on lobby boarding counts alone ("method 1").

In Step 1 the up-peak is assumed to start when the predicted lobby boarding counts for the next, for example, three (3) minute interval exceeds a predetermined threshold level, for example, two (2%) percent of the building population. In Step 2 the time when the predicted traffic reaches this level is recorded as the start (t_ust) of the up-peak period, and the up-peak flag is set to "ON."

With reference to Step 3, when the cars leave the lobby during up-peak, if, for example, the first three (3) successive cars are loaded more than, for example, sixty-five (65%) percent of capacity, in Step 4 the above boarding count criteria for the start of up-peak will be reduced by a fractional percentage point amount, for example, a quarter of a percent (0.25%) and this new value will be selected as the threshold for the next day. If the first three (3) successive cars leaving the lobby are less than, for example, fifty (50%) percent loaded (see Step 2), in Step 6 the boarding count criteria for the start of up-peak will be increased by a suitable fractional percent, for example, a quarter of a percent (0.25%), and this value will be selected as the threshold for the next day.

The invention thus allows for automatic "learning" of the correct traffic levels at which peak period should start.

In Step 7 (FIG. 5B), if up-peak is "ON," then the up-peak is assumed to end when the predicted lobby boarding counts for the next, for example, three (3) minute interval are less than, for example, a one and a half (1.5%) percent threshold of the building population. In Step 8 this time is recorded as the end of up-peak (t_ued), and the up-peak flag is set to "OFF."

In Step 9 (note FIG. 5B), if the next three (3) cars leaving the lobby within an exemplary three (3) minute time interval each have greater than, for example, a thirty-five (>35%) percent capacity load, then in Step 10 the up-peak ending threshold is decreased by a fractional percent point, for example, a quarter of a percentage point (0.25%), of the building population before "ENDing." On the other hand, in Step 11, if, for example, the next three (3) cars leaving the lobby each have less than a twenty-five (<25%) percent capacity load, then in Step 12 the up-peak ending threshold is increased by the fractional percentage point, for example, a quarter (0.25%) percent, before "ENDing." The new thresholds so selected are used for the next day.

The foregoing basic methodology can also be used in a similar fashion for predicting the start and end of down-peak using traffic levels based on lobby deboarding counts at the lobby in the "down" direction. The start and end times of the "noon" time "down" traffic and "up" traffic can also be defined using a similar approach and somewhat lower traffic levels.

Figure 6A:
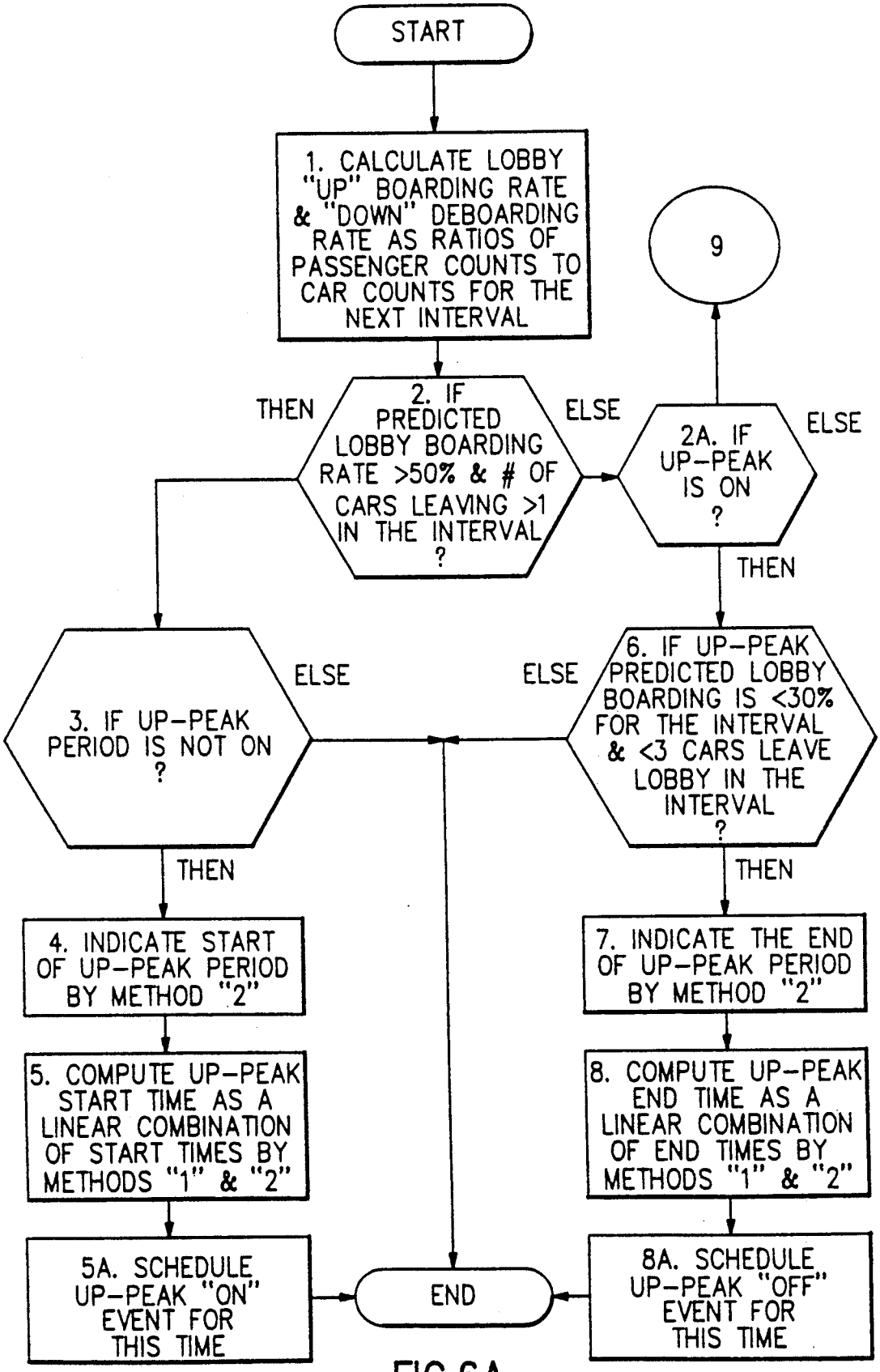
FIGS. 6A and 6B, in combination, is a simplified, logic, flow chart diagram for exemplary algorithm for the methodology used to predict the start and end of up-peak and down-peak periods based on the predicted lobby boarding and deboarding rates.
Figure 6B:
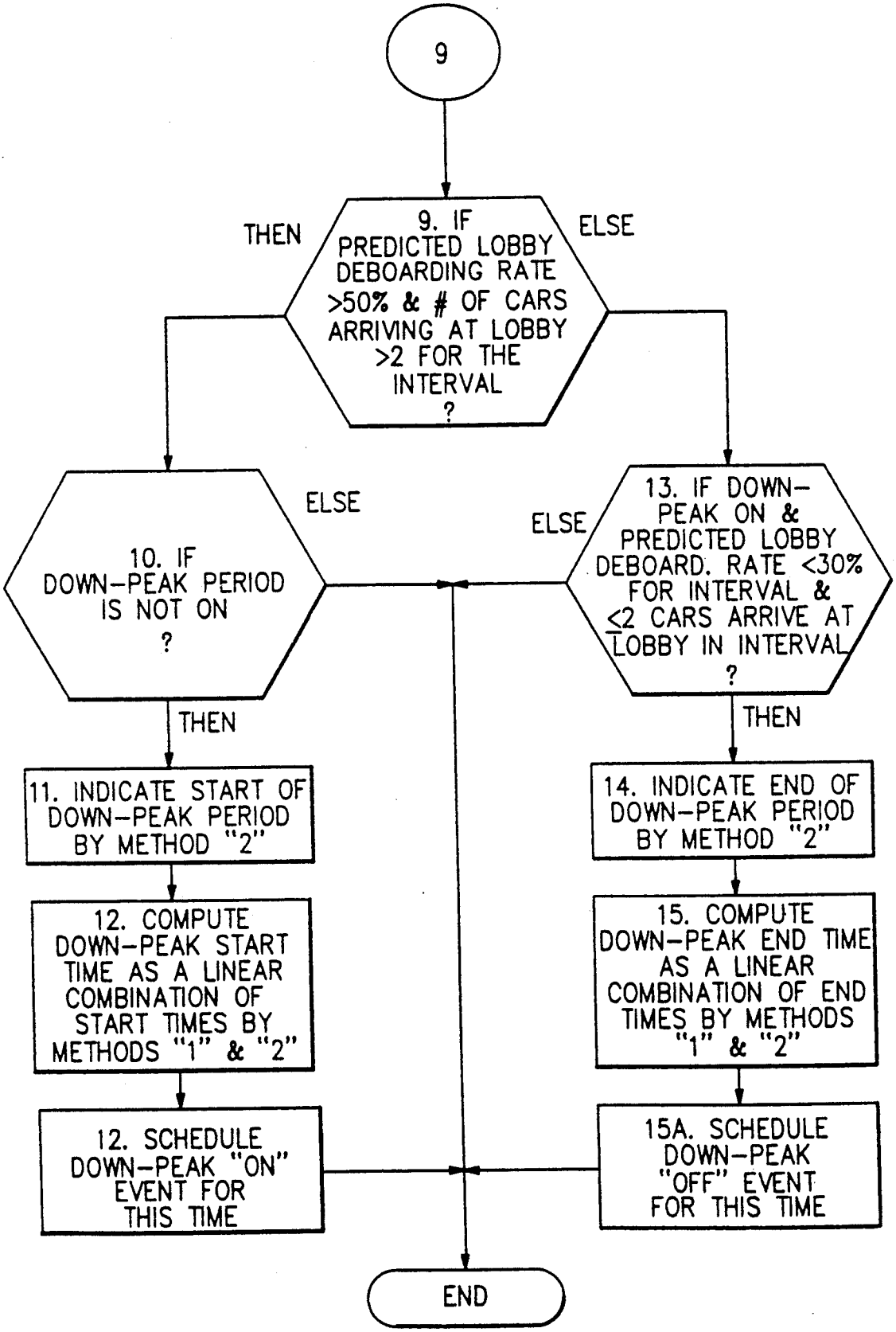

FIGS. 6A and 6B

FIGS. 6A and 6B, in combination, provide in step-by-step fashion a simplified, logic, flow chart diagram for the exemplary algorithm for the methodology used to predict the start and end of up-peak and down-peak based on predicted lobby boarding and deboarding rates, respectively.

In this alternate enhanced method of the invention, using the predicted passenger and car counts for each interval based on historic and real time predictions, in Step 1 the lobby "up" direction passenger boarding rate and lobby "down" direction deboarding rate are first calculated. The boarding rate is calculated as the ratio of total number of passengers boarding the cars at the lobby in the "up" direction during that interval to the number of cars departing the lobby in the "up" direction during the same interval. The deboarding rate is calculated as the ratio of the number of passengers deboarding the cars at the lobby in the "down" direction in that interval to the number of car arrival counts at the lobby in the "down" direction in the same interval.

In Step 2, if the predicted lobby boarding rate in the "up" direction exceeds, for example, fifty (>50%) percent and the number of cars leaving the lobby in the "up" direction is at least, for example, two (2) cars [i.e., more than (>1)] in the interval, and up-peak in not "ON" (Step 3), then the start of the up-peak period is indicated by this method (method "2"; Step 4). If the above conditions are not met and if up-peak is "ON" (Step 2A), in Step 6, if the predicted number of cars leaving the lobby in the "up" direction in the interval is two (2) or less [i.e. less than three (<3)] and the average predicted boarding rate is less than, for example, thirty (<30%) persent, then the end of the up-peak period is indicated by this method (method "2"; Step 7).

In Step 5 the predicted up-peak starting time is selected as a linear function of the time indicated by the boarding counts (method 1) and the time indicated by the boarding rate (method 2). In Step 5A the up-peak "ON" event is scheduled for this time. The same basic approach is used for predicting up-peak end time (Step 8), and up-peak "OFF" event is scheduled for this time (Step 8A). Such an approach results in accurate prediction of the starting and ending times.

Thus:

$$t_{pd}=a*t_{pd1}+b*t_{pd2}$$

where:

$t_{pd1}$=predicted time from lobby boarding counts;

$t_{pd2}$=predicted time from lobby boarding rate;

$t_{pd}$=final predicted start/end time; and

"a" and "b" are coefficients whose summation is unity (a+b=1).

If on the other hand in Step 2A it was decided that up-peak was not "ON," then in Step 9 (FIG. 6B), if the predicted lobby deboarding rate in the "down" direction exceeds, for example, fifty (>50%) percent, and the number of cars arriving at the lobby in the "down" direction exceeds, for example, two (2) cars in the interval and the down-peak flag is not "ON" (Step 10), the start of the down-peak period is indicated by this method (method 2; Step 11). If the above conditions are not met, then in Step 13, if the predicted number of cars arriving at the lobby in the "down" direction in the interval is two (2) or less and the average predicted deboarding rate is less than, for example, thirty (<30%) percent, then the end of the down-peak period is indicated by this method (method 2; Step 14).

Likewise, in Step 12 the predicted down-peak starting time is selected as a linear function of the time indicated by the deboarding counts (method 1) and the time indicated by the deboarding rate (method 2). In Step 12A the down-peak "ON" event is scheduled for this time. The same approach is used for predicting downpeak end time in Step 15. In Step 15A the downpeak "OFF" event is scheduled for this time.

This more sophisticated method provides for "learning" the best combination of historic and real time data to be used in predicting lobby boarding and deboarding counts and rates. It also provides for learning the best combination of predicted times based on traffic counts and boarding or deboarding rates that result in accurate prediction of these times.

By predicting the lobby boarding and deboarding counts and rates before their actual occurrence, the dispatch of empty cars to the lobby or to the upper floors where traffic originates is appropriately advanced. Such a strategy reduces the passenger queue lengths and waiting times at the start of the peak periods.

Additionally, by using the predicted traffic levels to select the ending time of the peak periods, the premature termination of the peak dispatch strategy due to short fluctuation in passenger arrival rates is also avoided. This improves the elevator service towards the end of the peak period.

It should be understood that, with respect to historic data, the references above, for example, to the "next day" refer to the "next normal day" and references to the past "several days" refer to the previous several "normal" or work days, all typically involving a working weekday. Thus, for example, weekend days (Saturdays and Sundays) and holidays will not have meaningful or true peak periods and are not included in the peak period strategies of the invention, and their data will not appear in the recorded historic data, unless in fact peak periods do occur on those days.

Although this invention has been shown and described with respect to detailed, exemplary embodiments thereof, it should be understood by those skilled in the art that various changes in form, detail, methodology and/or approach may be made without departing from the spirit and scope of this invention.

Having thus described at least one exemplary embodiment of the invention, that which is new and desired to be secured by Letters Patent is claimed below:

1. In an elevator dispatching system controlling the assignment of elevator cars from a lobby level to various floors in a building having a predetermined population, a method of determining the commencement of an UP-PEAK period of operation, said method comprising the steps of:

obtaining historical information of the number of passengers boarding the elevators at the lobby during a plurality of predetermined time intervals, said time intervals being within a predetermined time period;

predicting a lobby boarding count for a specific predetermined time interval based on said historical information;

comparing said predicted lobby boarding count with a predetermined percentage of the building's population; and commencing UP-PEAK operation at the beginning of said specific time interval if said predicted lobby boarding count is greater than said predetermined percentage of the building's population.

2. The method of claim 1, said method further comprising the steps of:

determining the load of at least the first two elevators leaving the lobby during said specific time interval if UP-PEAK operation was commenced at the beginning thereof; and adjusting said predetermined percentage based on said determined load.

3. The method of claim 2, wherein said step of adjusting said predetermined percentage comprises the step of decreasing said predetermined percentage by a predetermined amount if said determined load is greater than or equal to a predetermined percentage of the elevator car's capacity.

4. The method of claim 3, wherein said predetermined amount is about 0.25 percent.

5. The method of claim 3, wherein said predetermined percentage of the elevator car's capacity is about 65 percent.

6. The method of claim 2, wherein said step of adjusting said predetermined percentage comprises the step of increasing said predetermined percentage by a predetermined amount if said determined load is less than or equal to a predetermined percentage of the elevator car's capacity.

7. The method of claim 6, wherein said predetermined amount is about 0.25 percent.

8. The method of claim 6, wherein said predetermined percentage of the elevator car's capacity is about 50 percent.

9. The method of claim 1, wherein said predetermined percentage of the building's population is about 2 percent.

10. The method of claim 1, said method further comprising the steps of:

adjusting the beginning of the predetermined time period based on the starting time of UP-PEAK operation, said adjusted predetermined time period to be used for obtaining a subsequent day's historical information.

11. The method of claim 10, wherein said predetermined time period is adjusted to begin about 15 minutes before the previous day's starting time of UP-PEAK operation.

12. In an elevator dispatching system controlling the assignment of elevator cars from a lobby level to various floors in a building having a predetermined population, a method of determining the conclusion of an UP-PEAK period of operation, said method comprising the steps of:

obtaining historical information of the number of passengers boarding the elevators at the lobby during a plurality of predetermined time intervals, said time intervals being within a predetermined time period;

predicting a lobby boarding count for a specific predetermined time interval based on said historical information;

comparing said predicted lobby boarding count with a predetermined percentage of the building's population; and concluding UP-PEAK operation at the beginning of said specific time interval if said predicted lobby boarding count is less than said predetermined percentage of the building's population.

13. The method of claim 12, said method further comprising the steps of:

determining the load of at least the first two elevators leaving the lobby during said specific time interval if UP-PEAK operation was concluded at the beginning thereof; and adjusting said predetermined percentage based on said determined load.

14. The method of claim 13, wherein said step of adjusting said predetermined percentage comprises the step of decreasing said predetermined percentage by a predetermined amount if said determined load is greater than or equal to a predetermined percentage of the elevator car's capacity.

15. The method of claim 14, wherein said predetermined amount is about 0.25 percent.

16. The method of claim 14, wherein said predetermined percentage of the elevator car's capacity is about 35 percent.

17. The method of claim 13, wherein said step of adjusting said predetermined percentage comprises the step of increasing said predeterminded percentage by a predetermined amount if said determined load is less than or equal to a predetermined percentage of the elevator car's capacity.

18. The method of claim 17, wherein said predetermined amount is about 0.25 percent.

19. The method of claim 17, wherein said predetermined percentage of the elevator car's capacity is about 25 percent.

20. The method of claim 12, wherein said predetermined percentage of the building's population is about 1.5 percent.

21. The method of claim 12, said method further comprising the steps of:

adjusting the end of the predetermined time period based on the concluding time of UP-PEAK operation, said adjusted predetermined time period to be used for obtaining a subsequent day's historical information.

22. The method of claim 21, wherein said predetermined time period is adjusted to end about 15 minutes after the previous day's ending time of UP-PEAK operation.

23. In an elevator dispatching system controlling the assignment of elevator cars from various floors to a lobby level in a building having a predetermined population, a method of determining the commencement of a DOWN-PEAK period of operation, said method comprising the steps of:

obtaining historical information of the number of passengers deboarding the elevators at the lobby during a plurality of predetermined time intervals, said time intervals being within a predetermined time period;

predicting a lobby deboarding count for a specific predetermined time interval based on said historical information;

comparing said predicted lobby deboarding count with a predetermined percentage of the building's population; and commencing DOWN-PEAK operation at the beginning of said specific time interval if said predicted lobby deboarding count is greater than said predetermined percentage of the building's population.

24. The method of claim 23, said method further comprising the steps of:

determining the load of at least the first two elevators arriving at the lobby during said specific time interval if DOWN-PEAK operation was commenced at the beginning thereof; and adjusting said predetermined percentage based on said determined load.

25. The method of claim 24, wherein said step of adjusting said predetermined percentage comprises the step of decreasing said predetermined percentage by a predetermined amount if said determined load is greater than or equal to a predetermined percentage of the elevator car's capacity.

26. The method of claim 25, wherein said predetermined amount is about 0.25 percent.

27. The method of claim 25, wherein said predetermined percentage of the elevator car's capacity is about 65 percent.

28. The method of claim 24, wherein said step of adjusting said predetermined percentage comprises the step of increasing said predetermined percentage by a predetermined amount if said determined load is less than or equal to a predetermined percentage of the elevator car's capacity.

29. The method of claim 28, wherein said predetermined amount is about 0.25 percent.

30. The method of claim 28, wherein said predetermined percentage of the elevator car's capacity is about 50 percent.

31. The method of claim 23, wherein said predetermined percentage of the building's population is about 2 percent.

32. The method of claim 23, said method further comprising the steps of:

adjusting the beginning of the predetermined time period based on the starting time of DOWN-PEAK operation, said adjusted predetermined time period to be used for obtaining a subsequent day's historical information.

33. The method of claim 32, wherein said predetermined time period is adjusted to begin about 15 minutes before the previous day's starting time of DOWN-PEAK operation.

34. In an elevator dispatching system controlling the assignment of elevator cars from various floors to a lobby level in a building having a predetermined population, a method of determining the conclusion of a DOWN-PEAK period of operation, said method comprising the steps of:

obtaining historical information of the number of passengers deboarding the elevators at the lobby during a plurality of predetermined time intervals, said time intervals being within a predetermined time period;

predicting a lobby deboarding count for a specific predetermined time interval based on said historical information;

comparing said predicted lobby deboarding count with a predetermined percentage of the building's population; and concluding DOWN-PEAK operation at the beginning of said specific time interval if said predicted lobby deboarding count is less than said predetermined percentage of the building's population.

35. The method of claim 34, said method further comprising the steps of:

determining the load of at least the first two elevators arriving at the lobby during said specific time interval if DOWN-PEAK operation was concluded at the beginning thereof; and adjusting said predetermined percentage based on said determined load.

36. The method of claim 35, wherein said step of adjusting said predetermined percentage comprises the step of decreasing said predetermined percentage by a predetermined amount if said determined load is greater than or equal to a predetermined percentage of the elevator car's capacity.

37. The method of claim 36, wherein said predetermined amount is about 0.25 percent.

38. The method of claim 36, wherein said predetermined percentage of the elevator car's capacity is about 35 percent.

39. The method of claim 35, wherein said step of adjusting said predetermined percentage comprises the step of increasing said predetermined percentage by a predetermined amount if said determined load is less than or equal to a predetermined percentage of the elevator car's capacity.

40. The method of claim 39, wherein said predetermined amount is about 0.25 percent.

41. The method of claim 39, wherein said predetermined percentage of the elevator car's capacity is about 25 percent.

42. The method of claim 34, wherein said predetermined percentage of the building's population is about 1.5 percent.

43. The method of claim 34, said method further comprising the steps of:

adjusting the end of the predetermined time period based on the concluding time of DOWN-PEAK operation, said adjusted predetermined time period to be used for obtaining a subsequent day's historical information.

44. The method of claim 43, wherein said predetermined time period is adjusted to end about 15 minutes after the previous day's ending time of DOWN-PEAK operation.

45. In an elevator dispatching system controlling the assignment of elevator cars from a lobby level to various floors in a building, the system having a method of determining the commencement of an UP-PEAK period of operation based on a predicted lobby boarding count and a predetermined threshold value, a method of adjusting said threshold value comprising the steps of:

predicting said lobby boarding count based on historical information of the number of passengers boarding the elevators at the lobby during a predetermined time interval;

comparing said predicted lobby boarding count with said predetermined threshold value;

commencing UP-PEAK operation if said predicted lobby boarding count is greater than said predetermined threshold value; and adjusting said threshold value based on actual passengers boarding the elevators at the lobby during at least a portion of UP-PEAK operation.

46. The method of claim 45, wherein said predetermined threshold value is a predetermined percentage of the building population.

47. The method of claim 45, wherein the step of adjusting said threshold value comprises the steps of:

determining the load of at least the first two elevators leaving the lobby during a predetermined time interval within UP-PEAK operation; and adjusting said predetermined threshold value based on said determined load.

48. The method of claim 47, wherein said step of adjusting said predetermined threshold value based on said determined load comprises the step of decreasing said predetermined threshold value by a predetermined amount if said determined load is greater than or equal to a predetermined percentage of the elevator car's capacity.

49. The method of claim 47, wherein said step of adjusting said predetermined threshold value based on said determined load comprises the step of increasing said predetermined threshold value by a predetermined amount if said determined load is less than or equal to a predetermined percentage of the elevator car's capacity.

50. In an elevator dispatching system controlling the assignment of elevator cars from a lobby level to various floors in a building, the system having a method of determining the conclusion of an UP-PEAK period of operation based on a predicted lobby boarding count and a predetermined threshold value, a method of adjusting said threshold value comprising the steps of:

predicting said lobby boarding count based on historical information of the number of passengers boarding the elevators at the lobby during a first predetermined time interval;

comparing said predicted lobby boarding count with said predetermined threshold value;

concluding UP-PEAK operation if said predicted lobby boarding count is less than said predetermined threshold value; and adjusting said threshold value based on actual passengers boarding the elevators at the lobby during a second predetermined time interval after the conclusion of UP-PEAK operation.

51. The method of claim 50, wherein said predetermined threshold value is a predetermined percentage of the building population.

52. The method of claim 50, wherein the step of adjusting said threshold value comprises the steps of:

determining the load of at least the first two elevators leaving the lobby during said second predetermined time interval after the conclusion of UP-PEAK operation; and adjusting said predetermined threshold value based on said determined load.

53. The method of claim 52, wherein said step of adjusting said predetermined threshold value based on said determined load comprises the step of decreasing said predetermined threshold value by a predetermined amount if said determined load is greater than or equal to a predetermined percentage of the elevator car's capacity.

54. The method of claim 52, wherein said step of adjusting said predetermined threshold value based on said determined load comprises the step of increasing said predetermined threshold value by a predetermined amount if said determined load is less than or equal to a predetermined percentage of the elevator car's capacity.

55. In an elevator dispatching system controlling the assignment of elevator cars from various floors to a lobby level in a building, the system having a method of determining the commencement of a DOWN-PEAK period of operation based on a predicted lobby deboarding count and a predetermined threshold value, a method of adjusting said threshold value comprising the steps of:

predicting said lobby deboarding count based on historical information of the number of passengers deboarding the elevators at the lobby during a predetermined time interval;

comparing said predicted lobby deboarding count with said predetermined threshold value;

commencing DOWN-PEAK operation if said predicted lobby deboarding count is greater than said predetermined threshold value; and adjusting said threshold value based on actual passengers deboarding the elevators at the lobby during at least a portion of DOWN-PEAK operation.

56. The method of claim 55, wherein said predetermined threshold value is a predetermined percentage of the building population.

57. The method of claim 55, wherein the step of adjusting said threshold value comprises the steps of:

determining the load of at least the first two elevators arriving at the lobby during a predetermined time interval within DOWN-PEAK operation; and adjusting said predetermined threshold value based on said determined load.

58. The method of claim 57, wherein said step of adjusting said predetermined threshold value based on said determined load comprises the step of decreasing said predetermined threshold value by a predetermined amount if said determined load is greater than or equal to a predetermined percentage of the elevator car's capacity.

59. The method of claim 57, wherein said step of adjusting said predetermined threshold value based on said determined load comprises the step of increasing said predetermined threshold value by a predetermined amount if said determined load is less than or equal to a predetermined percentage of the elevator car's capacity.

60. In an elevator dispatching system controlling the assignment of elevator cars from various floors to a lobby level in a building, the system having a method of determining the conclusion of a DOWN-PEAK period of operation based on a predicted lobby deboarding count and a predetermined threshold value, a method of adjusting said threshold value comprising the steps of:

predicting said lobby deboarding count based on historical information of the number of passengers deboarding the elevators at the lobby during a first predetermined time interval;

comparing said predicted lobby deboarding count with said predetermined threshold value;

concluding DOWN-PEAK operation if said predicted lobby deboarding count is less than said predetermined threshold value; and adjusting said threshold value based on actual passengers deboarding the elevators at the lobby during a second predetermined time interval after the conclusion of DOWN-PEAK operation.

61. The method of claim 60, wherein said predetermined threshold value is a predetermined percentage of the building population.

62. The method of claim 60, wherein the step of adjusting said threshold value comprises the steps of:

determining the load of at least the first two elevators arriving at the lobby during said second predetermined time interval after the conclusion of DOWN-PEAK operation; and adjusting said predetermined threshold value based on said determined load.

63. The method of claim 62, wherein said step of adjusting said predetermined threshold value based on said determined load comprises the step of decreasing said predetermined threshold value by a predetermined amount if said determined load is greater than or equal to a predetermined percentage of the elevator car's capacity.

64. The method of claim 62, wherein said step of adjusting said predetermined threshold value based on said determined load comprises the step of increasing said predetermined threshold value by a predetermined amount if said determined load is less than or equal to a predetermined percentage of the elevator car's capacity.

* * * * *